US009095485B2

(12) United States Patent
Matsubara et al.

(10) Patent No.: US 9,095,485 B2
(45) Date of Patent: Aug. 4, 2015

(54) INFANT INCUBATOR

(71) Applicant: ATOM MEDICAL CORPORATION, Tokyo (JP)

(72) Inventors: Kazuo Matsubara, Tokyo (JP); Terumi Matsubara, Saitama (JP); Kenji Kobayashi, Saitama (JP); Yoko Kodaira, Saitama (JP); Keisuke Wakabayashi, Saitama (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 144 days.

(21) Appl. No.: 13/918,393

(22) Filed: Jun. 14, 2013

(65) Prior Publication Data

US 2013/0345494 A1 Dec. 26, 2013

(30) Foreign Application Priority Data

Jun. 25, 2012 (JP) ..... 2012-142282

(51) Int. Cl.
*A61G 11/00* (2006.01)

(52) U.S. Cl.
CPC ..... *A61G 11/00* (2013.01); *A61G 11/009* (2013.01)

(58) Field of Classification Search
CPC ... A61G 11/00; A61G 11/009; A61G 11/005; A61G 11/006; A61G 2203/46
USPC ..... 600/22
See application file for complete search history.

(56) References Cited

U.S. PATENT DOCUMENTS

2001/0049465 A1* 12/2001 Goldberg et al. ..... 600/22

FOREIGN PATENT DOCUMENTS

JP 2001-070367 A 3/2001

* cited by examiner

*Primary Examiner* — Christine H Matthews
(74) *Attorney, Agent, or Firm* — Arent Fox LLP

(57) ABSTRACT

An infant incubator including: an infant chamber isolated from external air; a conditioning bath communicating with the infant chamber; an air-conditioning equipment circulating air in the infant chamber through the conditioning bath; a fan provided at the air-conditioning equipment and moving air in the conditioning bath; a heater provided at the air-conditioning equipment and heating the air in the conditioning bath; a humidifier provided at the air-conditioning equipment, removably installed on a constructional member of the conditioning bath, and supplying water-vapor to the air in the conditioning bath; and a channel member for supplying water-vapor removably installed on a water-vapor introduction port penetrating the constructional member of the conditioning bath, and connecting the humidifier and the conditioning bath, in this infant incubator, the channel member for supplying water-vapor closes the water-vapor introduction port when the humidifier is removed, and opens the water-vapor introduction port when the humidifier is installed.

2 Claims, 15 Drawing Sheets

INFANT INCUBATOR

BACKGROUND OF THE INVENTION

1. Field of the Invention

The present invention relates to an infant incubator which can nurse an infant in an infant chamber isolated from external air.

Priority is claimed on Japanese Patent Application No. 2012-142282, filed Jun. 25, 2012, the content of which is incorporated herein by reference.

2. Description of the Related Art

In an enclosed incubator for nursing a premature baby in isolated environment from external air, in order to maintain temperature and humidity substantially stable and to keep hygiene in an infant chamber for protecting the baby, air-conditioning equipment is incorporated. The air-conditioning equipment introduces external air into the infant chamber while filtrating, and also supplies air which is appropriately conditioned in the temperature and the humidity by a heater, a humidifier and the like so as to circulate through the infant chamber. With respect to the humidifier in such air-conditioning equipment, for the purpose of simplicity of supplying water, it is suggested to form the humidifier so as to be removable from a principal body of the infant chamber.

For example, in Japanese Unexamined Patent Application, First Publication No. 2001-70367, an infant incubator having a removable humidifier is described. In this infant incubator, by providing a valve which can open and close a communication hole for supplying water-vapor, the communication between the infant chamber and the exterior through the communication hole is prevented in a state in which the humidifier is removed, so that appropriate environment in the infant chamber can be maintained.

SUMMARY OF THE INVENTION

Problems to be Solved by the Invention

As a humidifier provided with such an infant incubator, a heating-humidifier in which germs can be prevented from breeding comparing with a ultrasonic-humidifier or the like, is commonly used because a diffusing-port of water-vapor is hot when humidifying. However, even though in the heating-humidifier is used, the germs are apt to breed at the diffusing-port of water-vapor by condensation when the water-vapor is not vaporized. Therefore, in order to keep hygiene in the infant incubator protecting the baby having a weak resistance, it is necessary to reliably clean and disinfect the diffusing-port of water-vapor in which the germs are apt to breed.

The present invention is achieved in consideration of the above circumstances, and has an object to provide an infant incubator in which it can be performed reliably and easily to clean and disinfect around a diffusing-port for supplying water-vapor into an infant chamber.

Means for Solving the Problem

The present invention is an infant incubator including: an infant chamber which is isolated from external air; a conditioning bath communicating with the infant chamber; an air-conditioning equipment circulating air in the infant chamber through the conditioning bath; a fan which is provided at the air-conditioning equipment and moves the air in the conditioning bath; a heater which is provided at the air-conditioning equipment and heats the air in the conditioning bath; a humidifier which is provided at the air-conditioning equipment, removably installed on a constructional member of the conditioning bath, and supplies water-vapor to the air in the conditioning bath; and a channel member for supplying water-vapor which is removably installed on a water-vapor introduction port penetrating the constructional member of the conditioning bath, and connects the humidifier and the conditioning bath. In this infant incubator, the channel member for supplying water-vapor closes the water-vapor introduction port when the humidifier is removed, and opens the water-vapor introduction port when the humidifier is installed.

According to the infant incubator, since the channel member for supplying water-vapor, which connects the humidifier and the conditioning bath, can be removed from the water-vapor introduction port, the vicinity of the water-vapor introduction port can be reliably cleaned and disinfected. Moreover, since the water-vapor introduction port is open only when the humidifier is installed, the water-vapor introduction port is not open when the humidifier is not installed, even though the humidifier does not close the water-vapor introduction port. As a result, the infant chamber can be isolated from external air.

In this infant incubator, it is preferable that: the air-conditioning equipment be arranged under the infant chamber; the water-vapor introduction port substantially vertically penetrate the constructional member of the conditioning bath extending substantially horizontally; the channel member for supplying water-vapor which is installed on the water-vapor introduction port have a substantially cylindrical first member having a substantially vertical axis and being inserted into the water-vapor introduction port from above, and a second member having a substantially flat lower surface and being removably installed from below at a lower end of the first member in a state in which the constructional member of the conditioning bath is intervened, the channel member for supplying water-vapor be movable in a substantially-vertical-prescribed width with respect to the water-vapor introduction port; a cap member be provided at an upper part of the water-vapor introduction port so as to open and close the water-vapor introduction port by being moved up and down; the humidifier have a water-vapor column having a water-vapor supply port that is in contact with the lower surface of the second member at an upper end thereof; and by the humidifier is attached on the constructional member of the conditioning bath, the water-vapor column push up the channel member for supplying water-vapor so as to move up the cap member and open the water-vapor introduction port and connect the water-vapor supply port with the water-vapor introduction port.

According to the infant incubator, since the channel member for supplying water-vapor which opens and closes the water-vapor introduction port can be easily attached to and removed from the water-vapor introduction port, the vicinity of the water-vapor introduction port can be easily cleaned and disinfected. Moreover, since the open-close structure of the cap member of the water-vapor introduction port for sheltering the infant chamber from external air is simple, it can be performed reliably and easily to clean and disinfect.

Effects of the Invention

According to the infant chamber of the present invention, it can be performed reliably and easily to clean and disinfect around a diffusing-port for supplying water-vapor into an infant chamber, so that environment of a baby having a weak resistance can be hygienically maintained.

DETAILED DESCRIPTION OF THE INVENTION

Figure 1:
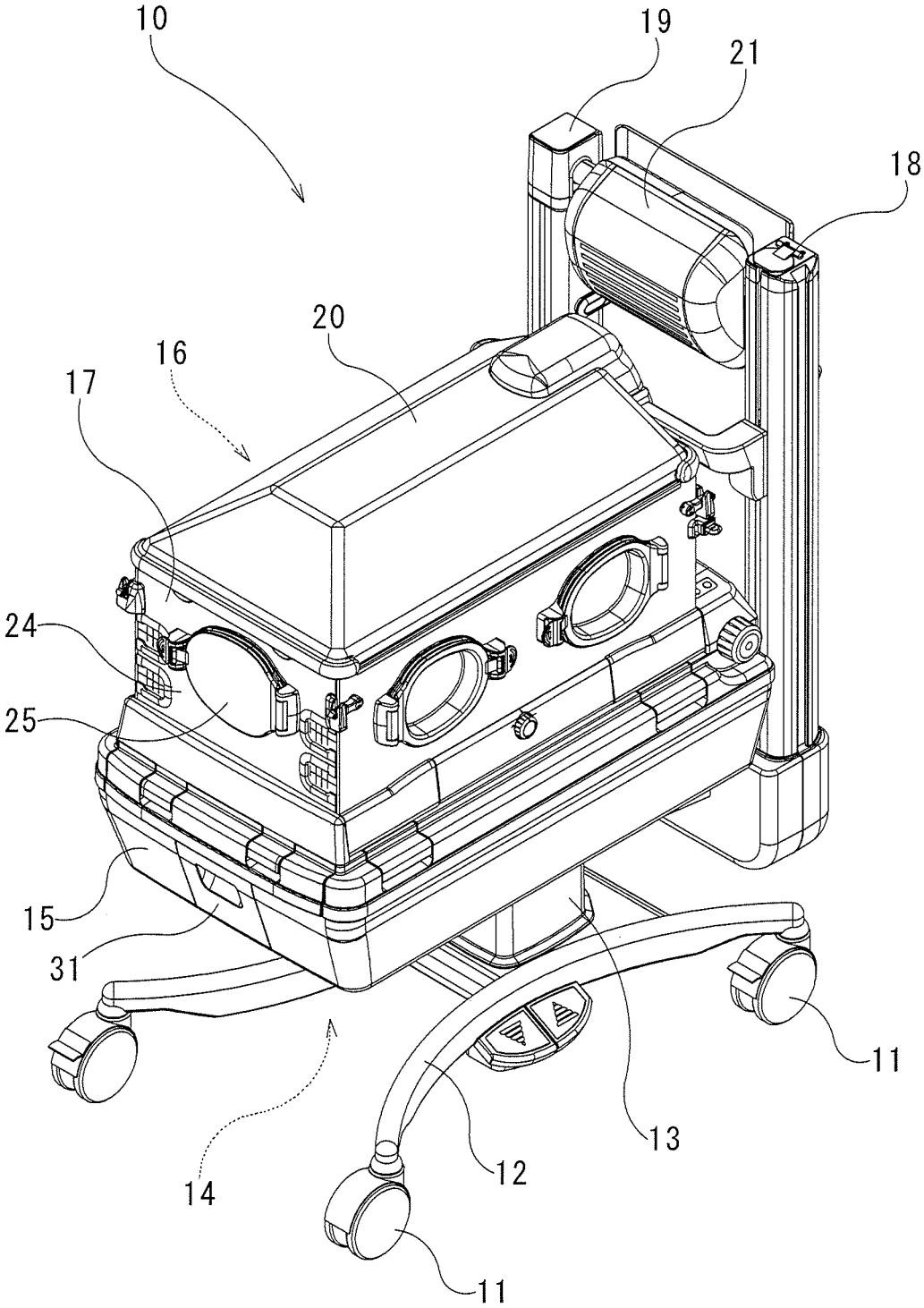
FIG. 1 is a perspective view showing an external view of an infant incubator of the present invention.
Figure 2:
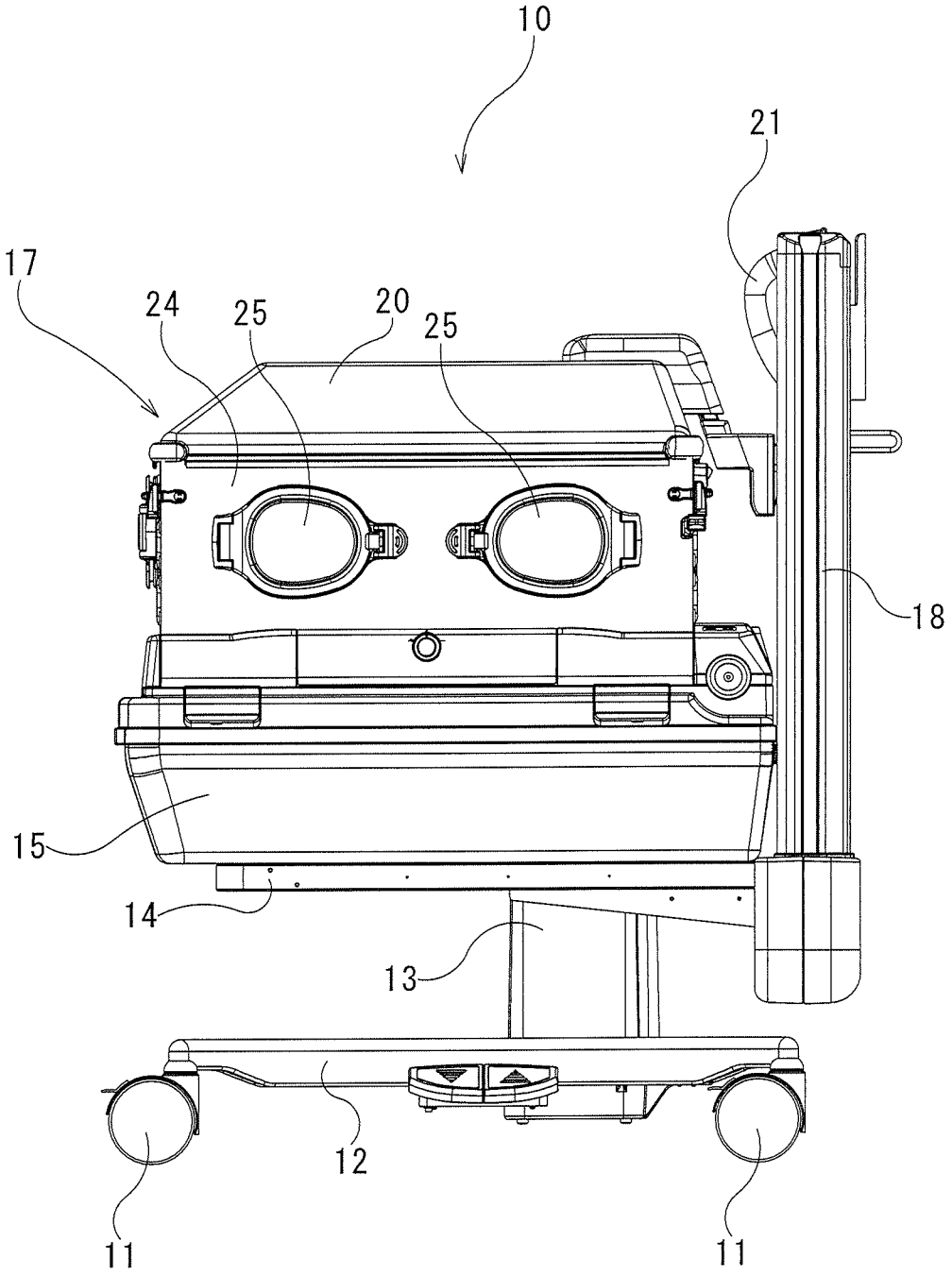
FIG. 2 is a side view showing the external of the infant incubator of FIG. 1.
Figure 3:
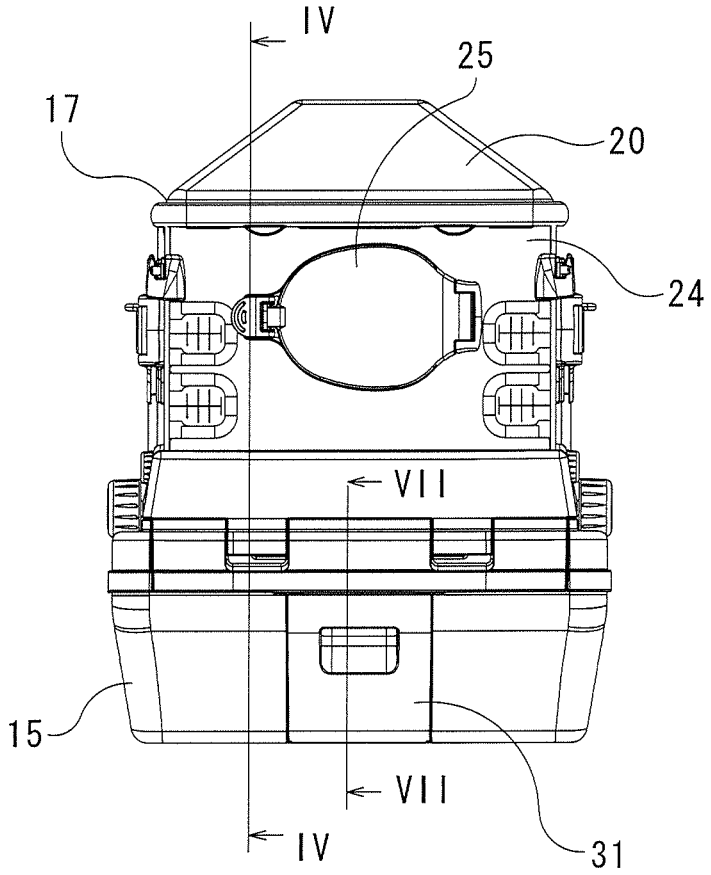
FIG. 3 is a front view showing a substantial part of the infant incubator from the left of FIG. 2.
Figure 4:
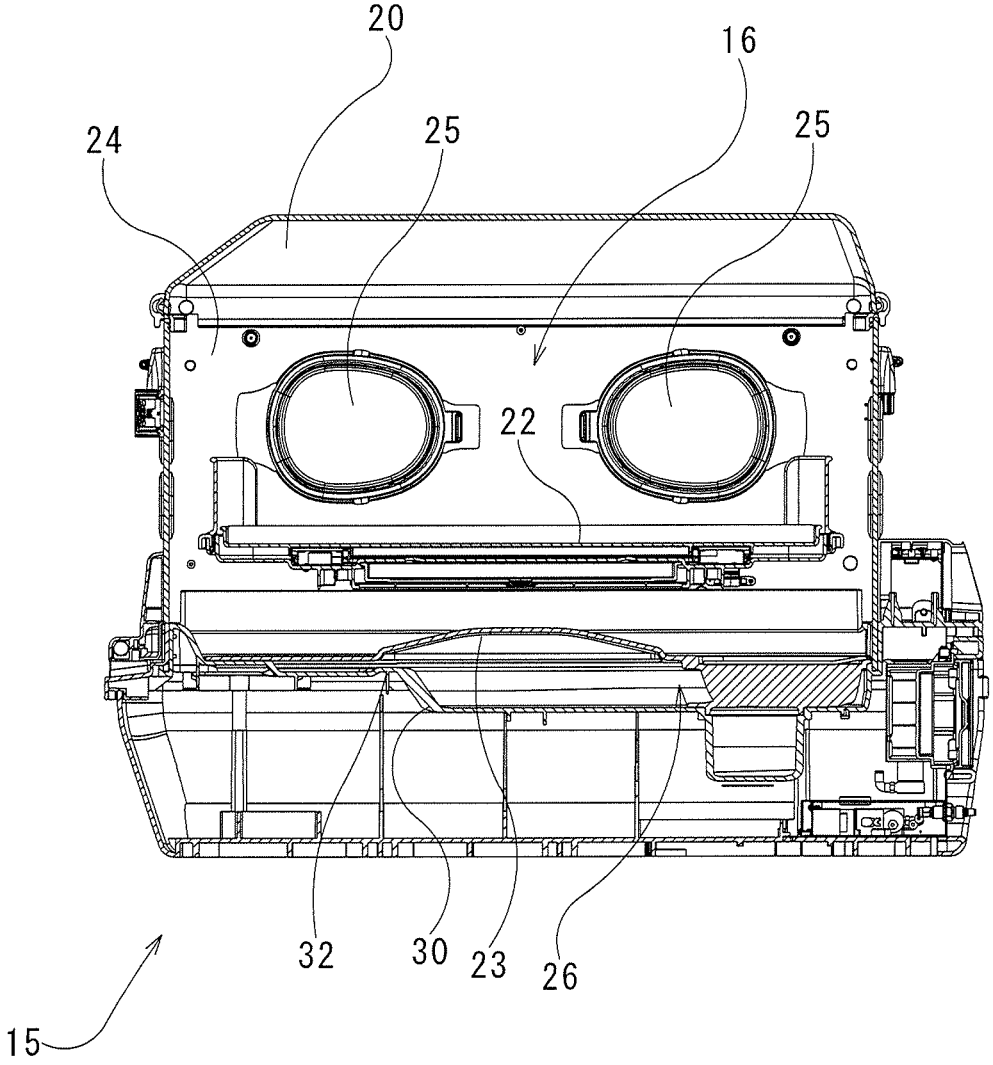
FIG. 4 is a cross-sectional view taken along the line IV-IV in FIG. 3, showing a substantial part of the infant incubator.

Below, an embodiment of an infant incubator according to the present invention will be explained with reference to drawings. As shown in FIGS. 1 and 2, an infant incubator 10 is provided with: a pedestal 12 which is movable by casters 11; a supporting post 13 which is vertically erected on the pedestal 12; a frame 14 which is provided at a top end of the supporting post 13; a base table 15 which is set on the frame 14; a hood 17 which is provided on the base table 15 and surrounds an infant chamber 16; two guide posts 18 and 19 which are vertically provided at an end portion of the frame 14 and at both sides of the hood 17; a canopy 20 which is set on a top end of the guide post 18 and composes a roof of the hood 17, and a heater 21 which is provided at a top end of the guide post 19. FIG. 3 is a front view showing a substantial part of the infant incubator 10; and FIG. 4 is a cross-sectional view of a substantial part of the infant incubator 10.

The hood 17 is constructed substantially rectangular from: a floor plate 23 in which a bed 22 for laying an infant down is mounted; treatment-doors 24 which are disposed each at a left side, a right side, a foot side, and a head side of the infant; and the canopy 20 which closes a top of the infant chamber 16 which is surrounded by the treatment doors 24. Sealing members are disposed between the floor plate 23, the treatment-doors 24, and the canopy 20 forming the hood 17, so that the infant chamber 16 is formed to be isolated from external air. The treatment-doors 24 and the canopy 20 are substantially entirely formed from transparent resin, so that the infant in the infant chamber 16 can be checked with eyes from the outside.

FIGS. 1 to 4 show the infant incubator 10 in a state in which the hood 17 is closed by moving down the canopy 12. Furthermore, in the infant incubator 10, the top of the infant chamber 16 can be open by moving up the canopy 20; and moreover, the treatment-doors 24 can be open except at the foot side. In this case, the infant chamber 16 can be heated by using the heater 21. Additionally, in a state of an enclosed incubator in which the hood 17 is closed, treatments for the infant can be operated through access ports 25 provided at the treatment-doors 24 though the treatment-doors 24 are closed.

Air-conditioning equipment 27 including a conditioning bath 26 which communicates with the infant chamber 16 is provided under the infant chamber 16, i.e., in the base table 15, so as to circulate air which is conditioned in temperature and humidity in the infant chamber 16 through the air-conditioning bath 26. The air-conditioning equipment 27 is provided with: a fan 28 moving the air in the conditioning bath 26; a heater 29 heating the air in the conditioning bath 26; and a humidifier 40 which is removably installed on a conditioning-bath base plate 30 (i.e., a construction member of the conditioning bath 26) and supplies water-vapor to the air in the conditioning bath 26, so that the air-conditioning equipment 27 can circulate the conditioned air in the temperature and the humidity to the infant chamber 16.

Figure 5:
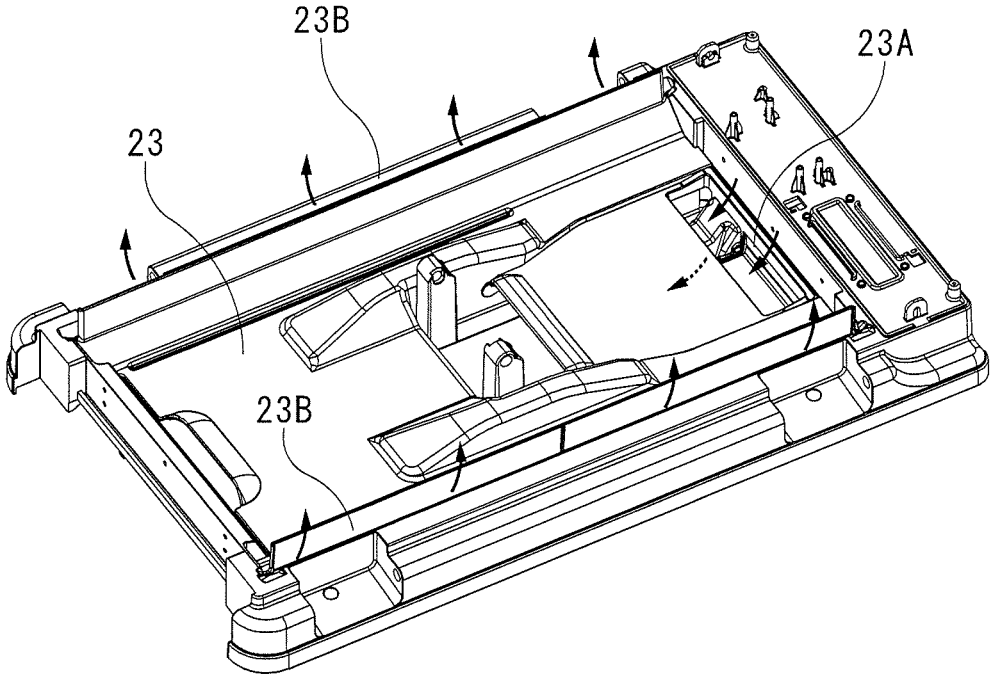
FIG. 5 is a perspective view showing the infant incubator in a state in which a bed arranged at a lower part of an infant chamber is removed so that a floor plate is exposed.

FIG. 5 shows a state in which the floor plate 23 is exposed by removing the bed 22 and the treatment-doors 24. In the infant incubator 10, the infant chamber 16 and the air-conditioning equipment 27 are separated by the floor plate 23. The conditioning bath 26 is formed under the floor plate 23, so that the air is taken into the conditioning bath 26 from the infant chamber 16 through an opening 23A provided at a rear side in the floor plate 23 (i.e., a right side in FIG. 2), and so that the air conditioned in the temperature and the humidity in the conditioning bath 26 is supplied from the conditioning bath 26 to the infant chamber 16 through openings 23B provided at both sides of the floor plate 23.

Figure 6:
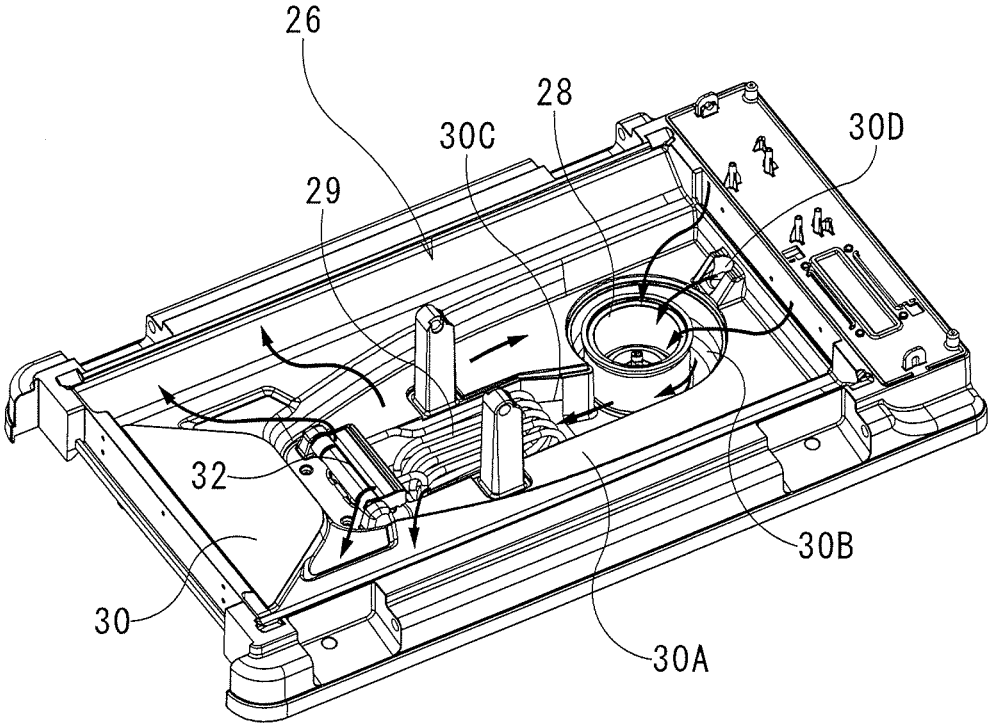
FIG. 6 is a perspective view showing the infant incubator in a state in which the floor plate of the infant chamber is removed so that a conditioning bath and air-conditioning equipment are exposed.

FIG. 6 shows a state in which the floor plate 23 is further removed. In the conditioning-bath base plate 30 arranged under the floor plate 23: a first recess 30A provided so as to form a space with respect to an under surface of the floor plate 23; a substantially cylindrical second recess 30B which is further depressed from a bottom surface of the first recess 30A, and in which the fan 28 is set; and a substantially box-like third recess 30C which is formed communicated with the second recess 30B along a longitudinal direction of the infant incubator 30B, and in which the heater 29 is set. Furthermore, an external-air intake port 30D is formed at the conditioning-bath base plate 30 in the vicinity of the second recess 30B. Moreover, a water-vapor introduction port 32 is formed at the conditioning-bath base plate 30 before (i.e., on a downstream of) the third recess 30C, so as to communicate with the humidifier 40 and substantially vertically penetrate the conditioning-bath base plate 30 extending substantially horizontally.

Figure 7:
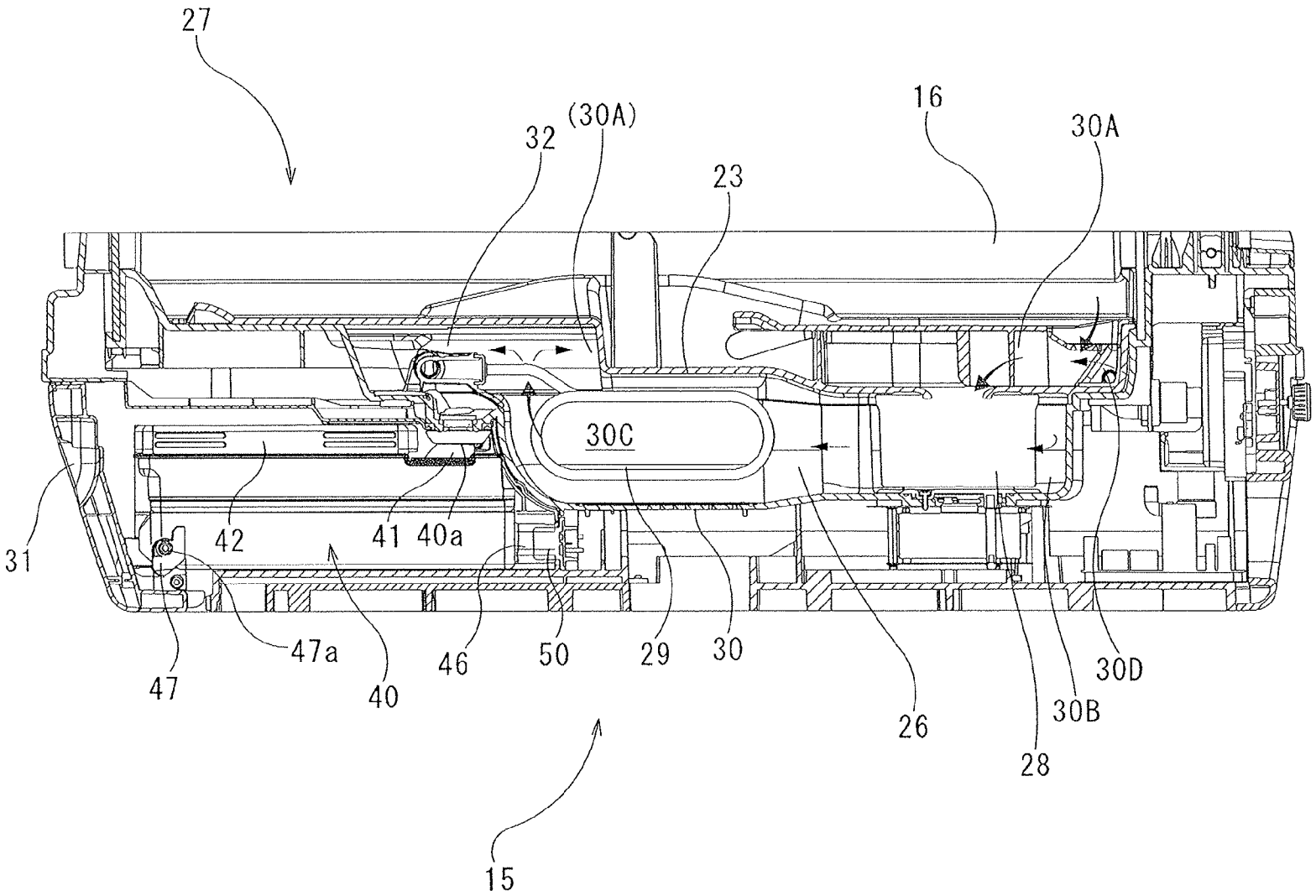
FIG. 7 is a cross-sectional view taken along the line VII-VII in FIG. 3 showing a substantially part of the infant incubator.

In the conditioning bath 26 formed between the conditioning-bath base plate 30 and the floor plate 23, the air from the infant chamber 16 at a side of the guide posts 18 and 19 and external air from the external-air intake port 30D suctioned by the fan 28 are introduced into the second recess 30B through the first recess 30A; then flow into the third recess 30C and are heated by the heater 29; and are humidified by the water-vapor supplied through the water-vapor introduction port 32 from the humidifier 40; finally, are supplied into the infant chamber 16 through the first recess 30A from between the floor plate 23 and the conditioning-bath base plate 30 at the side of the infant chamber 16. FIG. 7 shows the flow of the air in the air-conditioning equipment 27 constructed by the conditioning bath 26 formed by the floor plate 23 and the conditioning-bath base plate 30, the heater 29, and the humidifier 40.

Figure 8:
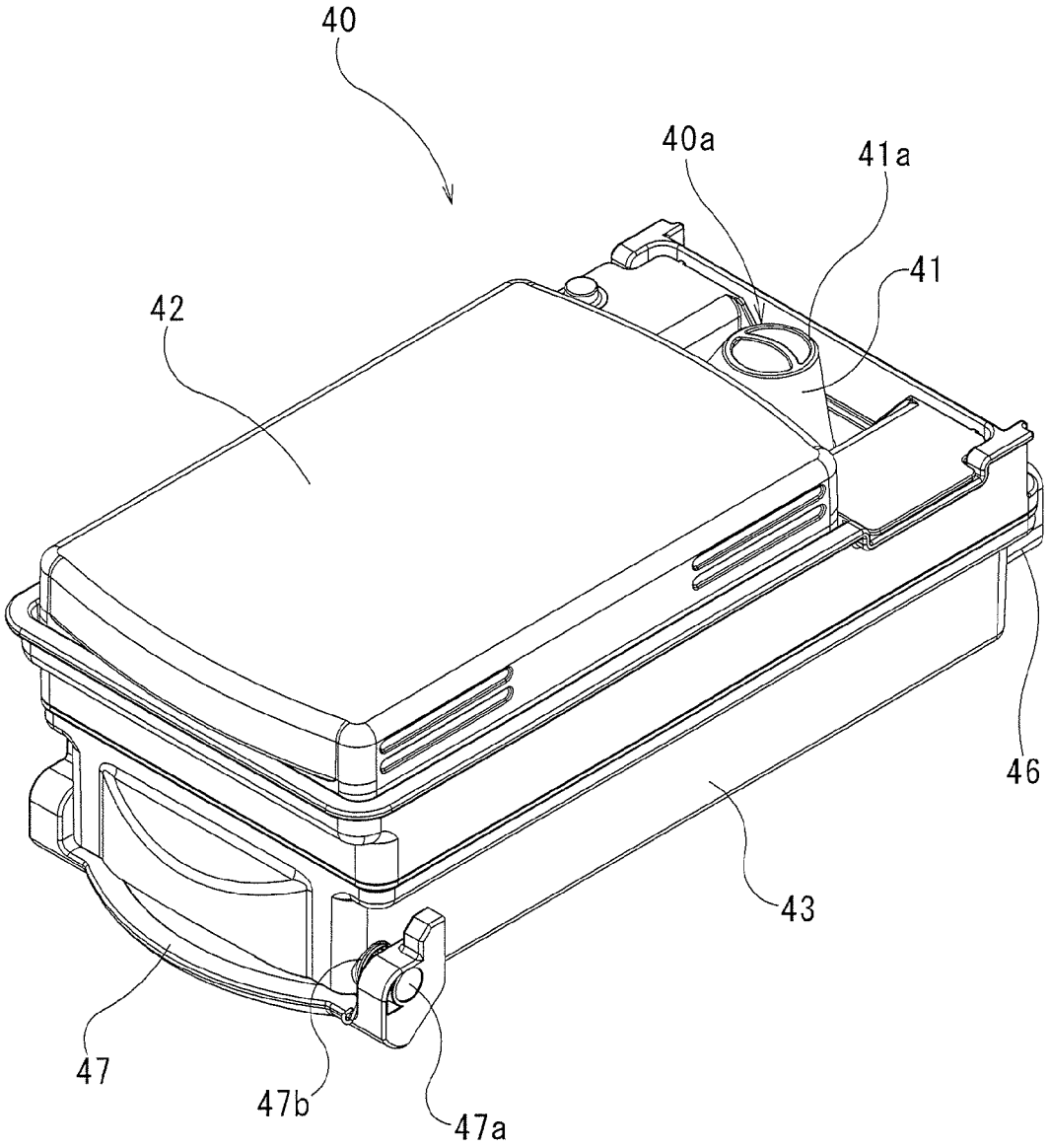
FIG. 8 is a perspective view showing a humidifier mounted on this infant incubator.
Figure 9:
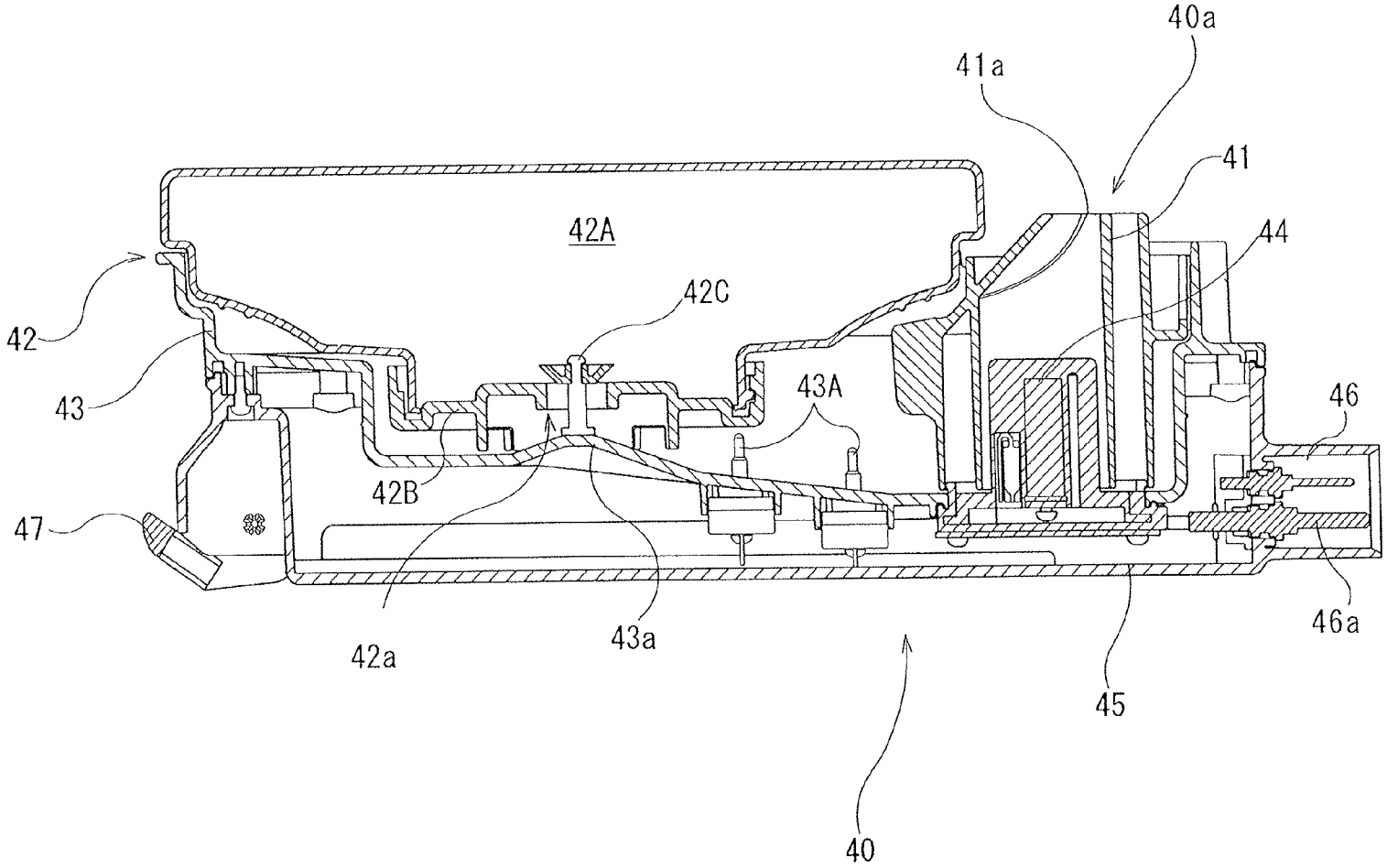
FIG. 9 is a cross-sectional view of the humidifier in FIG. 8.

The humidifier 40 of the air-conditioning equipment 27 is shown in FIGS. 8 and 9. The humidifier 40 is constructed by installing a water-vapor column 41 having a water-vapor supply port 40*a* communicating with the water-vapor introduction port 32 formed at an end portion at the downstream side of the third recess 30C at the conditioning-bath base plate 30 and a water tank 42 to a humidifying tank 43. In this humidifier 40, water supplied to the humidifying tank 43 from the water tank 42 is heated by a cartridge heater 44 arranged inside the water-vapor column 41, so that generated water-vapor is discharged from the water-vapor column 41 through the water-vapor supply port 40*a*. In addition, water-level sensors 43A are installed on a bottom surface in a reservoir part of water in the humidifying tank 43 so as to check quantity of water supplied to the cartridge heater 44.

As shown in FIG. 9, the water tank 42 of the humidifier 40 has: a tank body 42A storing water; a tank cap 42B attached to a lower part of the tank body 42A; and a valve member 42C which opens and closes a feeding portion 42*a* provided at the tank cap 42B. The valve member 42C is held to the tank cap 42B so as to slide vertically in a state of being pressed downwardly, opens the feeding portion 42*a* by being moved up with respect to the tank cap 42B, and closes the feeding portion 42*a* by being moved down.

When the water tank 42 is attached to the humidifying tank 43, the valve member 42C is moved up with respect to the tank cap 42B by a protruded portion 43*a* formed at the humidifying tank 43, so that the water in the tank body 42A is supplied to the humidifying tank 43 by opening the feeding portion 42*a*. A water level in the humidifying tank 43 is detected by the water-level sensors 43A. When the water level is unusual, control is carried out, for example, to stop supplying electricity to the cartridge heater 44.

The humidifying tank 43 on which the water-vapor column 41 and the water tank 42 are mounted is installed on a lower closer 45 having substantially a tray-shape. The lower closer 45 is provided with: a power connector 46 supplying electricity to the cartridge heater 44; and a handle 47 for reliably installing the humidifier 40 to the base table 15 (the conditioning-bath base plate 30). As shown in FIG. 8, the handle 47 is rotatably installed around a mounting shaft 47*a*, and biased to be rotated to a direction of moving away from the lower closer 45 by a helical-torsion-coil spring 47*b* installed to the mounting shaft 47*a*.

As shown in FIG. 7, when a base-table flapper 31 is closed in a state in which the humidifier 40 is installed in the base table 15, the handle 47 is pushed by the base-table flapper 31 to be rotated, so that the humidifier 40 is biased by the helical-torsion-coil spring 47*b* toward the conditioning-bath base plate 30.

Figure 10:
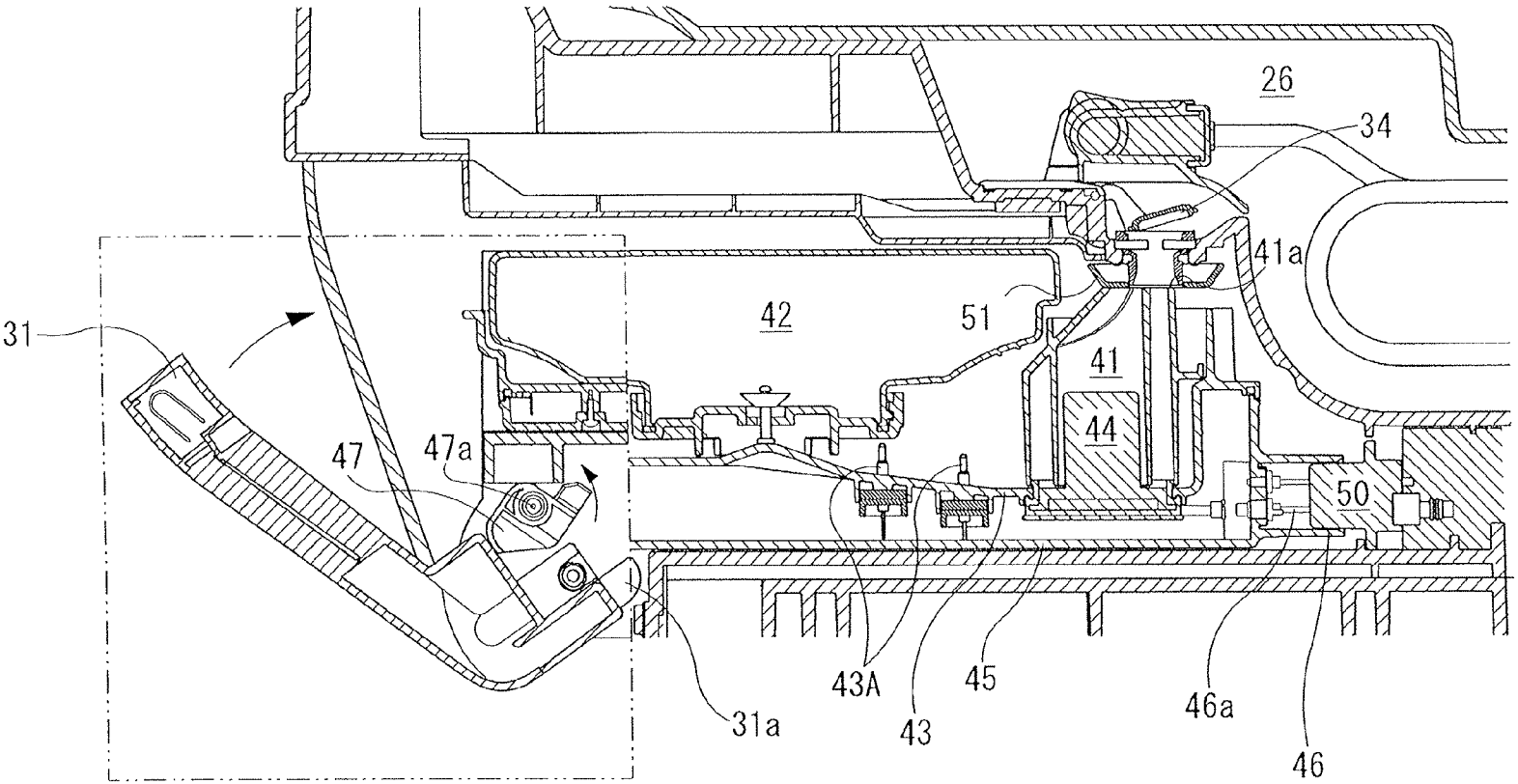
FIG. 10 is a cross-sectional view showing a state in which the humidifier is installed in a base table of the infant incubator and a base-table flapper is closed.

When the humidifier 40 is installed, as shown in FIG. 10, the humidifier 40 which is inserted into the base table 15 is pushed horizontally toward the right side in the drawings until top ends of connector pins 46*a* of the power connector 46 are in contact with a plug 50 which is provided in the base table 15, and then the base-table flapper 31 is closed as shown by arrows in the drawings. By closing the base-table flapper 31: the handle 47 is pushed by the base-table flapper 31 with being rotated around the mounting shaft 47*a*; and the humidifier 40 is moved horizontally and further pushed into the base table 15.

Figure 12:
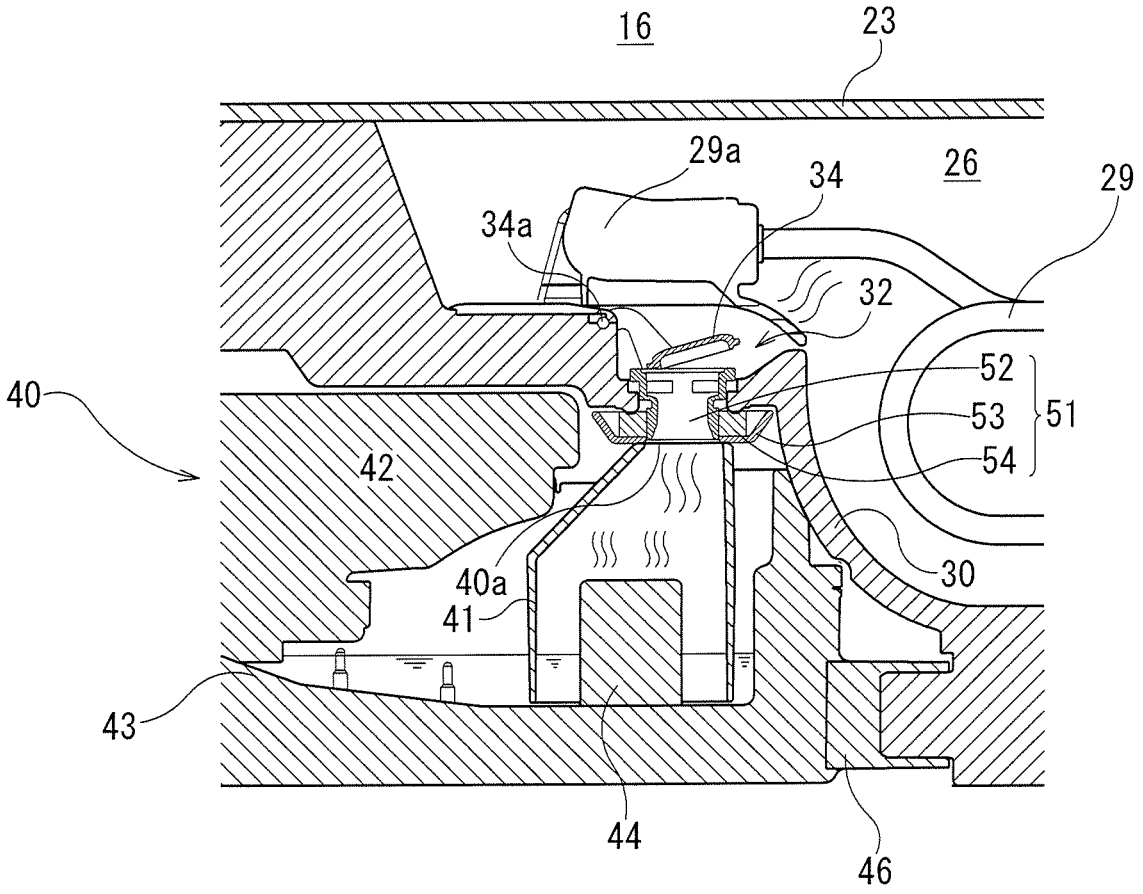
FIG. 12 is a cross-sectional view showing a vicinity of a water-vapor introduction port in the air-conditioning equipment of this infant incubator.

By pushing the humidifier 40 into the base table 15, as shown in FIG. 7, the power connector 46 and the plug 50 are connected, so that the cartridge heater 44 is possible to heat. At the same time, an upper end surface 41*a* of the water-vapor column 41 is pulled under a channel member for supplying water-vapor 51 and pushes up the channel member 51. Accordingly, a steam cap (a cap member) 34 is pushed up and open, so that the water-vapor supplying port 40*a* of the humidifier 40 and the conditioning bath 26 are communicated. Finally, water vapor can be supplied. Refer to FIG. 12.

In FIG. 10, a portion contained by two-dot chain lines shows a cross-section taken along a different line than the other portion in order to explain a connection between the mounting shaft 47*a* of the handle 47 and the base-plate flapper 31.

Figure 11:
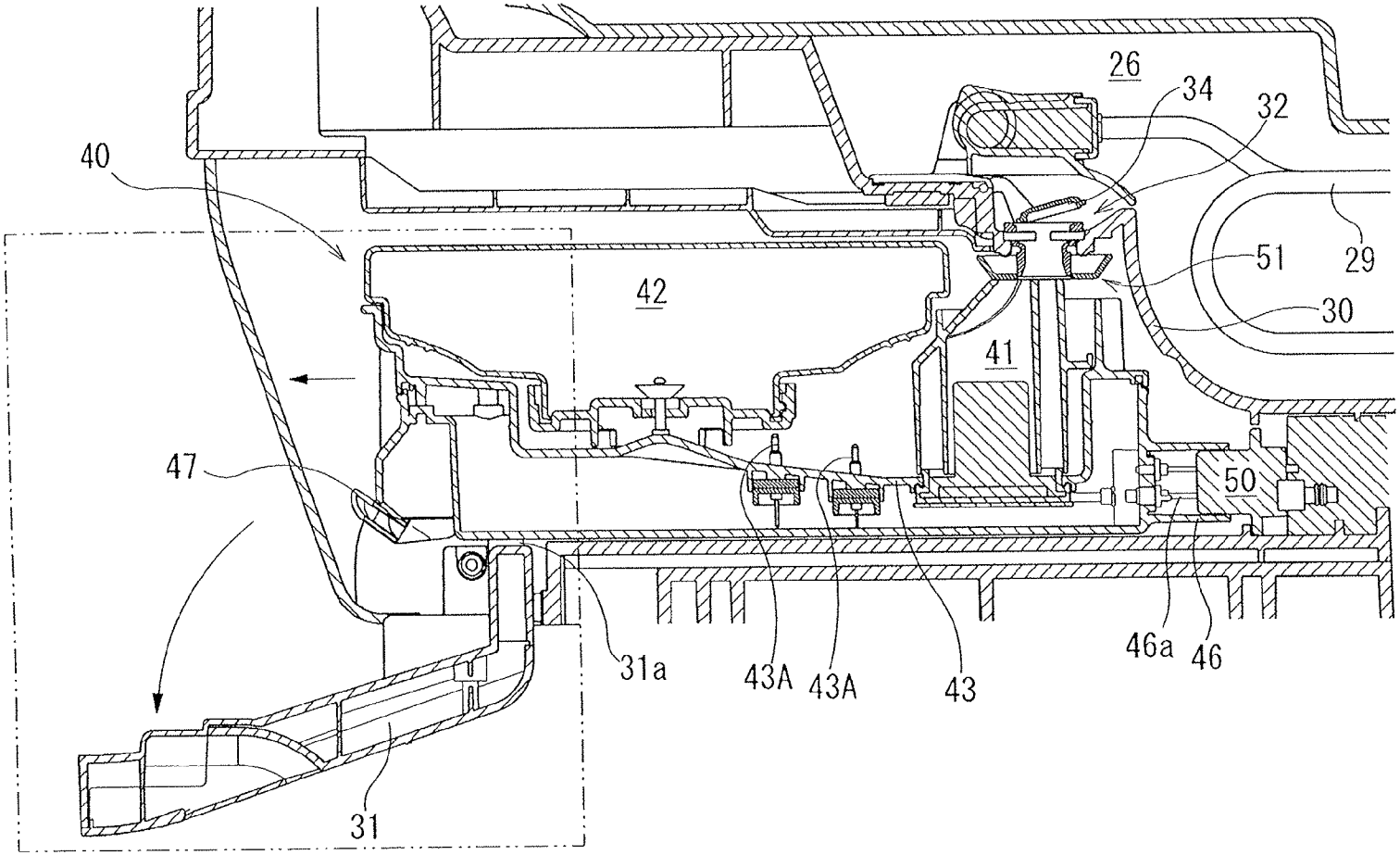
FIG. 11 is a cross-sectional view showing a state in which the base-table flapper of the infant incubator is open and the humidifier is to removed from within the base table.

On the other hand, when the humidifier 40 is removed, as shown in FIG. 11, by opening the base-table flapper 31, a hook 31*a* of the base-table flapper 31 (refer to FIG. 10) is engaged to a groove (not illustrated) of the humidifier 40 and rotated. As a result, the humidifier 40 is pushed by the hook 31*a* and drawn out; and a connection between the power connector 46 and the plug 50 is released. Furthermore, when the base-table flapper 31 is open, the handle 47 which is biased by the helical-torsion-coil spring 47*b* (refer to FIG. 8) is rotated, so that a space for resting fingers is formed. Therefore, the handle 47 can be held, so that the humidifier 40 can be drawn out horizontally.

Figure 14:
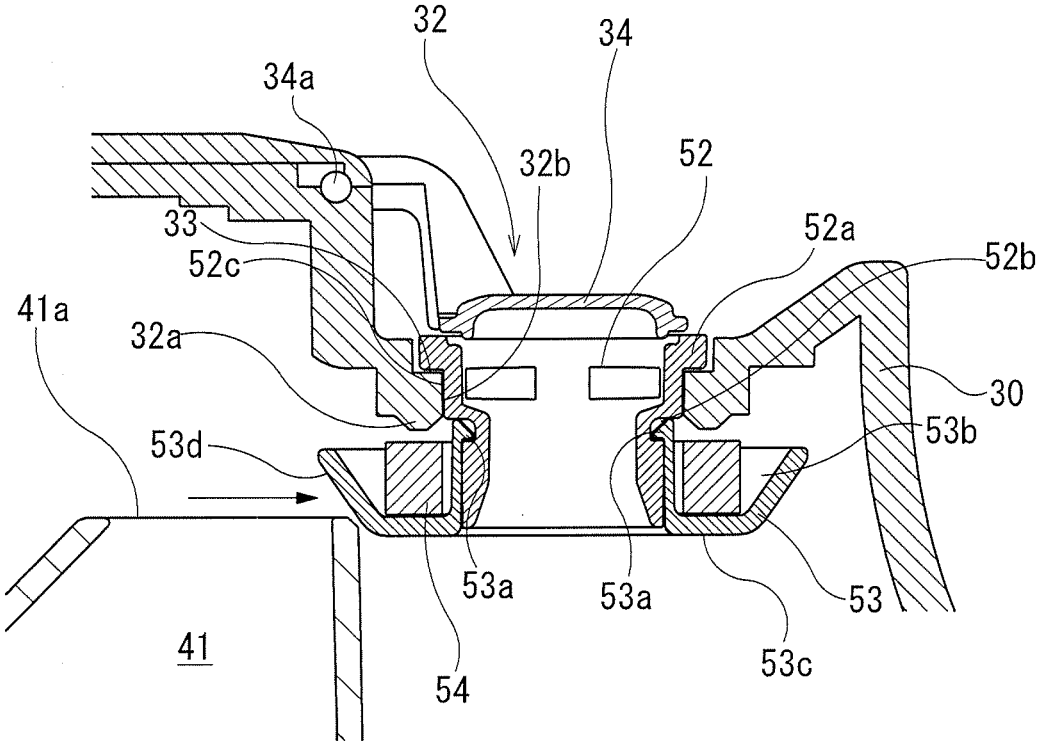
FIG. 14 is a cross-sectional view showing a state in which the channel member for supplying water-vapor is pushed up by a water-vapor column of the humidifier.

By drawing out the humidifier 40, the water-vapor column 41 is moved to the left in FIG. 11; and the channel member 51 which is supported from the bottom by the water-vapor column 41 is moved downward since the support from the bottom is lost (refer to FIG. 14). As a result, the steam cap 34 which is pushed up by the channel member 51 is rotated, so that the water-vapor introduction port 32 is closed; and then the conditioning bath 26 is maintained in a state of being isolated from the external air.

The opening and closing of the water-vapor introduction port 32 along with the attachment and removal of the humidifier 40 will be specifically explained. FIG. 12 shows a connection state between the water-vapor supply port 40*a* of the humidifier 40 and the water-vapor introduction port 32 of the conditioning-bath base plate 30. The channel member 51 for supplying water-vapor which is installed on the water-vapor introduction port 32 includes: a substantially cylindrical steam gate 52 (a first member) having a substantially vertical axis and being inserted into the water-vapor introduction port 32 from above; a steam slider 53 (a second member) having a substantially flat lower surface and being removably installed from below at a lower end of the steam gate 52 in a state in which the conditioning-bath base plate 30 is intervened; and a sealing member 54 which maintains air-tightness between the conditioning-bath base plate 30 and the channel member 51 by being pushed against an annular protrusion 32*a* which protrudes downward from an outer circumference of the bottom of the water-vapor introduction port 32.

Figure 13:
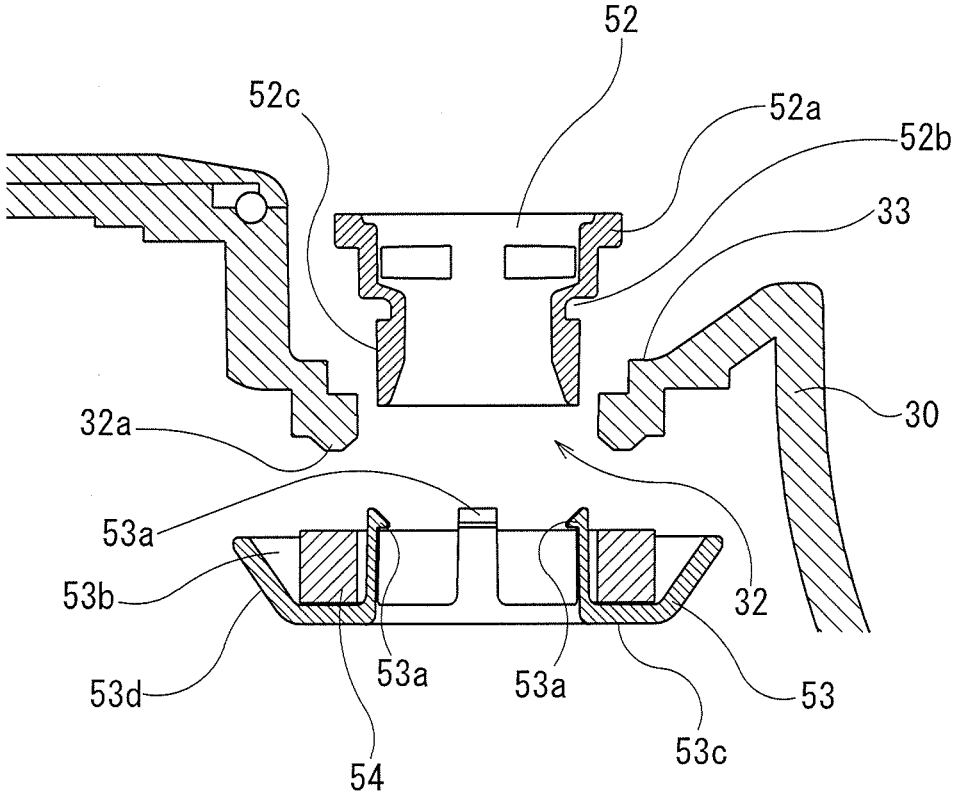
FIG. 13 is a cross-sectional view showing a composition of a channel member for supplying water-vapor attached to the water-vapor introduction port.

That is to say, the channel member 51 is removably attached to the water-vapor introduction port 32 which is formed penetrating the conditioning-bath base plate 30, so as to connect the humidifier 40 and the conditioning bath 26. As shown in FIG. 13, a flange portion 52*a* which is disposed on a flange-catch surface 33 of the conditioning-bath base plate 30 is formed at an upper portion of the substantially cylindrical steam gate 52. A maximum outer diameter of the flange portion 52*a* is larger than a maximum diameter of the water-vapor introduction port 32. Therefore, the steam gate 52 inserted in the water-vapor introduction port 32 from the above of the conditioning-bath base plate 30 is prevented from moving downward by the flange-catch surface 33 and does not fall through the water-vapor introduction port 32.

On the other hand, the steam slider 53 has hook portions 53*a* engaging a groove portion 52*b* annularly formed at an outer-circumferential surface of the steam gate 52, is formed to have substantially annular shape through which an cylindrical surface 52*c* of the steam gate 52 is inserted, and is attached to the steam gate 52 from the bottom with intervening the conditioning-bath base plate 30 in a state in which the annular sealing member 54 is stored in an annular recess portion 53*b* which is open upward. A substantially horizontal slide surface 53*c* and a tapered surface 53*d* which is connected to an outer circumference of the slide surface 53*c* and tapered off downward are formed at a bottom surface of the steam slider 53.

The steam cap (the cap member) 34 which opens and closes the water-vapor introduction port 32 is attached to the conditioning-bath base plate 30 above the water-vapor introduction port 32 (refer to FIG. 14). The steam cap 34 is rotated around a rotation shaft 34*a* and moved up and down along with the vertical movement of the channel member 51 with respect to the conditioning-bath base plate 30. When the humidifier 40 is installed, as shown in FIG. 12, the steam cap 34 is pushed up by the channel member 51, so that the water-vapor introduction port 32 is open. When the humidifier 40 is removed, as shown in FIG. 14, the steam cap 34 is moved down, so that the water-vapor introduction port 32 is closed.

As shown in FIG. 14, the steam gate 52 and the steam slider 53 are assembled with each other by engaging the groove portion 52*b* and the hook portions 53*a* so as to form the channel member 51 and held to the conditioning-bath base plate 30 at the water-vapor introduction port 32 with interposing the conditioning-bath base plate 30. The channel member 51 can move substantially vertically between a lowest position at which the flange portion 52*a* is mounted on the flange-catch surface 33 and a highest position at which the sealing member 54 is pushed against the protrusion 32*a*, in a state in which the horizontal movement is prevented by the engagement of the cylindrical surface 52*c* of the steam gate 52 and a cylindrical surface 32*b* of the water-vapor introduction port 32.

FIG. 14 shows a state in which the channel member 51 is in the lowest position. In this state, by the humidifier 40 being pushed in horizontally, the tapered surface 53*d* of the steam slider 53 is pushed up by the upper end of the water-vapor column 41. When the humidifier 40 is further pushed, as shown in FIG. 12, the substantially horizontal upper end surface 41*a* of the water-vapor column 41 supports the bottom of the slide surface 53*c* of the steam slider 53 from the bottom, so that the sealing member 54 is pushed against the protrusion 32*a*. At the same time, the steam cap 34 is pushed up by the steam gate 52 which is moved up. As a result, the inside of the water-vapor column 41 and the conditioning bath 26 are air-tightly communicated, so that the infant chamber 16 and the conditioning bath 26 can be humidified by the humidifier 40 in a state in which they are isolated from the external air.

On the contrary, when the humidifier 40 is drawn out horizontally, the support by the upper end surface 41*a* of the water-vapor column 41 is lost, and the channel member 51 is moved down to the lowest position; consequently, the steam cap 34 is also moved down. As a result, the water-vapor introduction port 32 is closed. That is to say, in a state in which the humidifier 40 is removed, the water-vapor introduction port 32 is closed, and the infant chamber 16 and the conditioning bath 26 are isolated from the external air.

Figure 15:
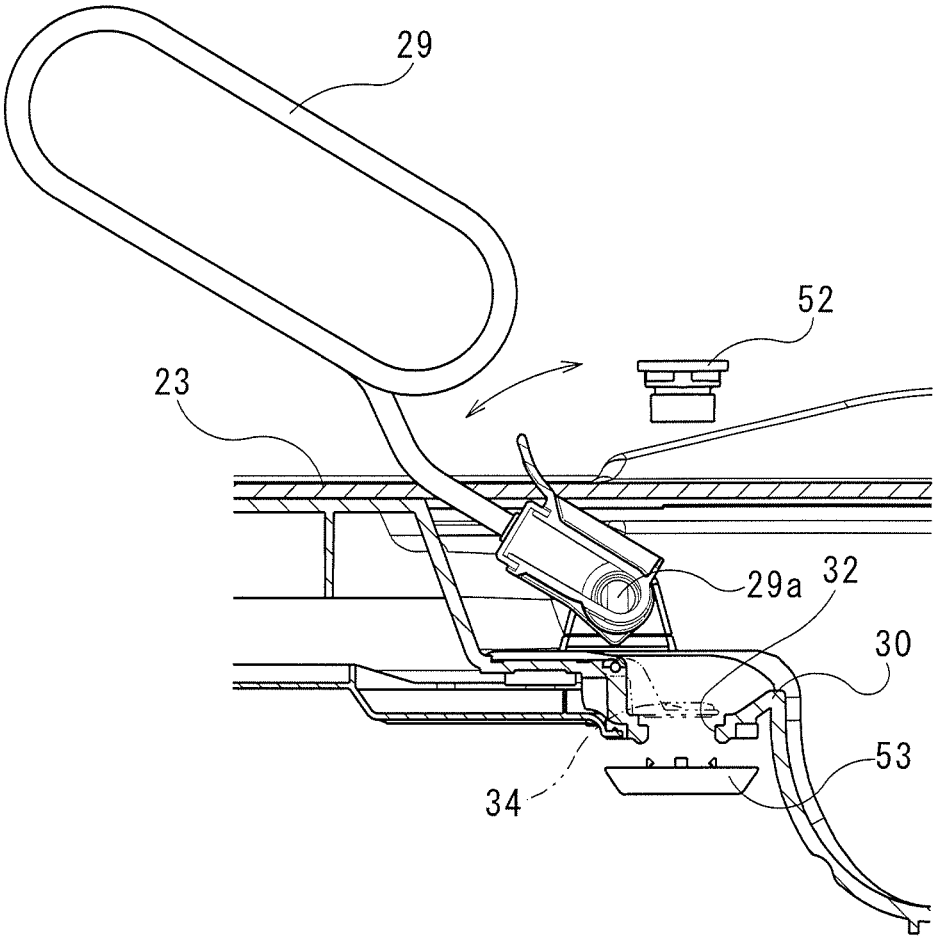
FIG. 15 is a cross-sectional view showing the vicinity of the water-vapor introduction port in a state in which the channel member for supplying water-vapor is removed from the water-vapor introduction port, and a heater is moved for the sake of easiness of cleaning and disinfecting the vicinity of the water-vapor introduction port.

As shown in FIG. 15, the heater 29 is installed on the conditioning-bath base plate 30 by a rotation shaft 29*a* extending substantially horizontally so as to rotate around the rotation shaft 29*a*. Therefore, the vicinity of the water-vapor introduction port 32 can be exposed, so that the channel member 51 can be attached and removed. Furthermore, when the channel member 51 is disassembled into the steam gate 52 and the steam slider 53 and dismounted from the conditioning-bath base plate 30, the vicinity of the water-vapor introduction port 32 can be easily and reliably cleaned and disinfected.

As described above, according to the infant incubator of the present invention, since the channel member for supplying water-vapor, which connects the humidifier and the conditioning bath of the air-conditioning equipment, can be removed form the construction member of conditioning bath (the conditioning-bath base plate), the vicinity of the water-vapor introduction port can be reliably cleaned and disinfected. Moreover, since the water-vapor introduction port is open only when the humidifier is installed, the infant chamber can be isolated from the external air. Furthermore, since the open-close structure of the cap member of the water-vapor introduction port for isolating the infant chamber from the external air is simple, it can be performed reliably and easily to clean and disinfect.

The present invention is not limited to the above-described embodiments and various modifications may be made without departing from the scope of the present invention.

What is claimed is:

1. An infant incubator comprising:

an infant chamber which is isolated from external air;

a conditioning bath communicating with the infant chamber;

an air-conditioning equipment circulating air in the infant chamber through the conditioning bath;

a fan which is provided at the air-conditioning equipment and moves the air in the conditioning bath;

a heater which is provided at the air-conditioning equipment and heats the air in the conditioning bath;

a humidifier which is provided at the air-conditioning equipment, removably installed on a constructional member of the conditioning bath, and supplies water-vapor to the air in the conditioning bath; and a channel member for supplying water-vapor which is removably installed on a water-vapor introduction port penetrating the constructional member of the conditioning bath, and connects the humidifier and the conditioning bath, wherein the channel member for supplying water-vapor closes the water-vapor introduction port when the humidifier is removed, and opens the water-vapor introduction port when the humidifier is installed.

2. The infant incubator according to claim 1, wherein:

the air-conditioning equipment is arranged under the infant chamber;

the water-vapor introduction port substantially vertically penetrates the constructional member of the conditioning bath extending substantially horizontally;

the channel member for supplying water-vapor which is installed on the water-vapor introduction port comprises: a substantially cylindrical first member having a substantially vertical axis and being inserted into the water-vapor introduction port from above; and a second member having a substantially flat lower surface and being removably installed from below at a lower end of the first member in a state in which the constructional member of the conditioning bath is intervened, so that the channel member for supplying water-vapor is movable in a substantially-vertical-prescribed region with respect to the water-vapor introduction port;

a cap member is provided at an upper part of the water-vapor introduction port so as to open and close the water-vapor introduction port by being moved up and down;

the humidifier comprises a water-vapor column having a water-vapor supply port that is in contact with the lower surface of the second member at an upper end thereof; and by attaching the humidifier on the constructional member of the conditioning bath, the water-vapor column pushes up the channel member for supplying water-vapor so as to move up the cap member and open the water-vapor introduction port and connect the water-vapor supply port with the water-vapor introduction port.

* * * * *